United States Patent [19]

White

[11] Patent Number: 4,495,486

[45] Date of Patent: Jan. 22, 1985

[54] SIMPLIFIED ALARM FOR A SLIDING DOOR OR THE LIKE

[76] Inventor: John D. White, 3705 Brunswick Dr., Toledo, Ohio 43606

[21] Appl. No.: 626,231

[22] Filed: Jun. 29, 1984

Related U.S. Application Data

[63] Continuation-in-part of Ser. No. 525,952, Aug. 24, 1983, Pat. No. 4,472,709.

[51] Int. Cl.[3] ..... G08B 13/08

[52] U.S. Cl. ..... 340/546; 200/61.73; 200/61.93

[58] Field of Search ..... 340/546, 545; 200/61.93, 61.73, 61.74, 61.71, 61.75

[56] References Cited

U.S. PATENT DOCUMENTS

| | | | |
|---|---|---|---|
| 2,870,281 | 1/1959 | Mitchell | 340/546 |
| 3,402,405 | 9/1968 | Contreras | 340/545 |
| 3,797,005 | 3/1974 | Schwarz | 340/545 |
| 3,797,006 | 3/1974 | Reininger | 340/545 |
| 4,193,067 | 3/1980 | Hawkins | 340/546 |
| 4,266,216 | 5/1981 | Trusty | 340/546 |

*Primary Examiner*—Glen R. Swann, III

*Attorney, Agent, or Firm*—Allen D. Gutchess, Jr.

[57] ABSTRACT

An alarm is operatively associated with a movable frame and a stationary frame of a sliding door assembly. It has a plunger engagable with one frame or the other, which plunger is urged outwardly and activates a signal if the alarm is removed from its position. The alarm includes a case in which a modular component can be inserted with the component including a source of power, contacts, and a signal which can be an audible signal or a sending signal which activates a remote burglar alarm. The case of the alarm has a locking pin which can lock the plunger in place when the alarm is removed by the occupant. The alarm is also designed with a gravity-operated block which prevents the plunger from being pushed back into the case to turn off the alarm unless the alarm is turned upside down.

20 Claims, 6 Drawing Figures

SIMPLIFIED ALARM FOR A SLIDING DOOR OR THE LIKE

CROSS-REFERENCE TO A RELATED APPLICATION

This application is a continuation-in-part of my copending application, Ser. No. 525,952, filed Aug. 24, 1983 now U.S. Pat. Ser. No. 4,472,709, issued 09/18/84.

BACKGROUND OF THE INVENTION

This invention relates to a simplified burglar alarm for use with a sliding door or the like.

Alarms of this general nature are known in prior art, such as in the Schwarz U.S. Pat. No. 3,797,005. In this patent, the alarm includes a plunger which activates a signal if the plunger is pushed in. However, if a window panel is broken and the alarm is removed, no signal will be activated. Mitchell U.S. Pat. No. 2,870,281 has a somewhat similar alarm which is used between a floor and a door knob to activate a signal if the door is attempted to be opened. Hawkins U.S. Pat. No. 4,193,067 shows an alarm which is similar to operation to that of the Schwarz patent.

SUMMARY OF THE INVENTION

The present invention provides an alarm for a sliding door assembly or the like which is designed to be positioned between a sliding door frame and a stationary frame of the sliding door assembly. The alarm includes a plunger which normally is engaged with the movable or stationary frame and activates a signal if the alarm is removed. Thus, the alarm is designed to prevent opening of the door by physical obstruction therewith. However, if an intruder breaks a glass panel and moves the alarm out of the way, the signal will then sound.

The alarm in accordance with the invention includes an adjustable rod member having one end adapted to engage the movable frame of the door or a stationary frame. At the other end of the rod member is a case containing a plunger which extends outwardly and engages the other of the movable and stationary frames. A spring urges the plunger outwardly and when the case is separated from the associated frame, the plunger does so move and activates a signal. The case also features a module chamber into which any of two or more modules can be selected and inserted. One module can contain a source of power in the nature of a battery, a pair of contacts which are engagable by the plunger when in its outer position, and an audible signal. Another module can be similar but contains a signal which emits a sending signal in the form of radio waves or the like to operate a remote burglar alarm. The appropriate module desired by the consumer can be quickly assembled into the case by the dealer or retailer at the time of sale of the alarm. This eliminates considerable inventory as compared to the situation where complete alarms containing either the audible signal or the sending signal are employed.

The alarm also includes a manually-operated locking pin which can prevent outward movement of the plunger when the occupant is to remove the alarm and open the door or the like. A further feature of the alarm is that the plunger, when it does move outwardly and activates the signal, is blocked by a gravity-operated block and cannot be pushed back into the case to turn off the signal without inverting the alarm.

It is, therefore, a principle object of the invention to provide a simplified alarm for a sliding door or the like having the features and advantages discussed above.

BRIEF DESCRIPTION OF THE DRAWINGS

Many other advantages and objects of the invention will be apparent from the following detailed description of a preferred embodiment thereof, reference being made to the accompanying drawings, in which.

DESCRIPTION OF THE PREFERRED EMBODIMENT

Figure 1:
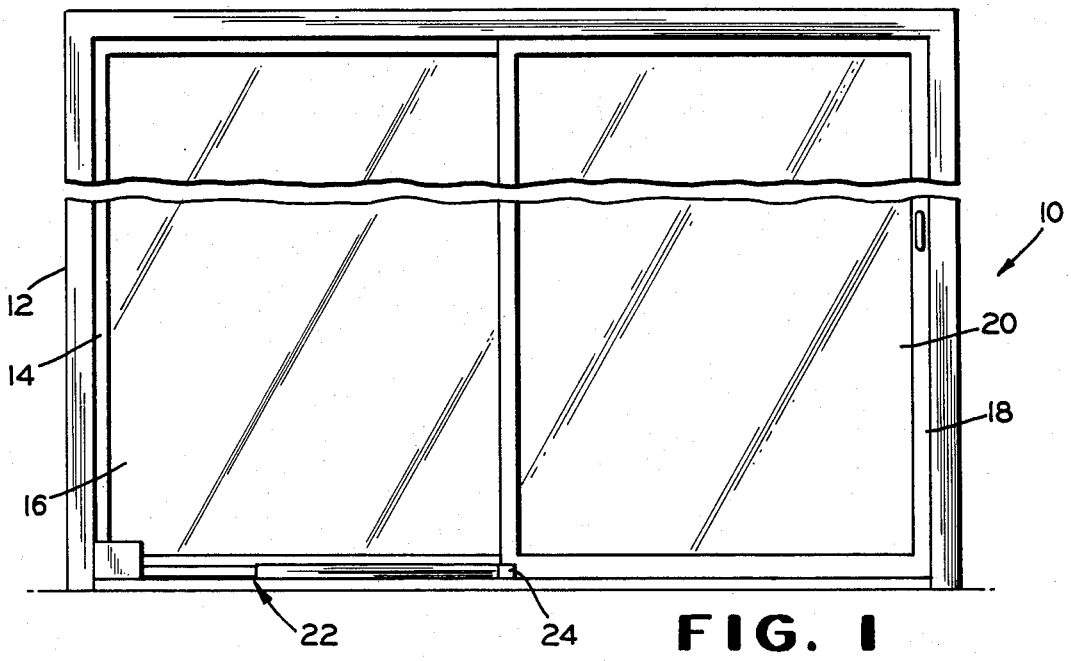
FIG. 1 is a view in elevation of a sliding door assembly and an alarm embodying the invention.

Referring to the drawings and particularly to FIG. 1, a sliding door assembly or the like is indicated at 10. This assembly could also be in the nature of a sliding window assembly or similar structure. The sliding door assembly 10 includes an outer, stationary frame 12 having a stationary panel frame 14 with a glass panel 16 and a sliding door 18 with a glass panel 20. In this instance, the door 18 slides inside the stationary panel.

A burglar alarm 22 in accordance with the invention is mounted between the sliding door frame 18 and the stationary frame 12. If the door 18 slides on the outside of the stationary panel, then a bracket or the like can be mounted on the door 18 to engage an end of the alarm 22, with the other end engaging the stationary frame 12. Otherwise, as shown, the alarm can have a bracket 24 which is of U-shaped configuration as viewed from above and which engages the edge of the door 18.

Figure 2:
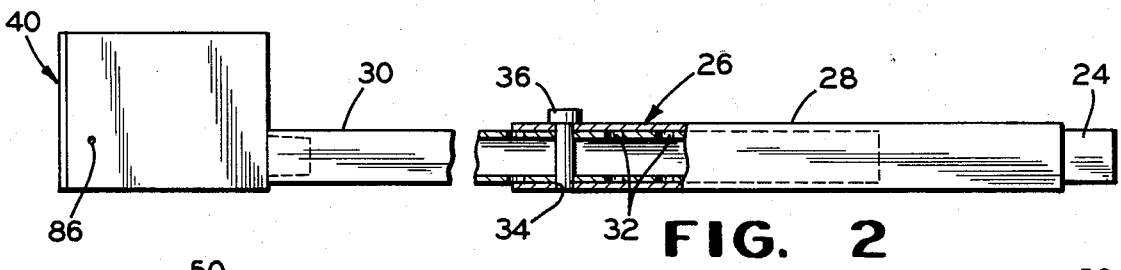
FIG. 2 is an enlarged view, with parts broken away, and with parts in section, of the alarm of FIG. 1.

The alarm 22, referring to FIG. 2, includes an elongate adjustable blocking member 26 comprising an outer tubular member 28 on which the bracket 24 is mounted and an inner tubular member 30 which telescopes into the member 28. The members are adjustable with the inner member 30 having a plurality of longitudinally-spaced, aligned holes 32 therein and the outer member 28 having holes 34 therein through which a pin 36 is inserted. The pin is inserted into any of the aligned holes 32 in the inner member 30 for longitudinal adjustment of the blocking member 26.

The inner member 30 is internally threaded at its outer end and receives a threaded nipple 38 on a case 40 constituting part of the alarm. The case 40 has a back wall 46, a bottom wall 48, an upper wall 50, and side walls 52 and 54. A guide wall 56 extends between the side walls 52 and 54 and divides the interior of the case into an upper module chamber 58 and a lower plunger chamber 60.

A plunger 62 has a plunger body 64 located in the plunger chamber 60 and a plunger pin 66 extending forwardly therefrom. The plunger pin 66 is preferably adjustable relative to the body 64 and for this purpose is shown as threaded and received in a threaded bore in the body. The plunger body 64 has an electrically-conductive face around the plunger pin 66 which can be formed by a conductive layer 68 or the plunger body itself can be of electrically-conductive material. The plunger is urged outwardly by a resilient coil spring 70 seated on a rear pin 72 of the plunger body 64 and against the rear wall 46 of the case 40. The plunger pin 66 is urged outwardly through a hole 74 and a removable cover 76 of the case 40 until it engages the frame with which it is associated. The plunger 62 then remains in that position until the alarm 22 is removed and plunger pin 66 is free of the frame. At this time, the spring 70 urges the plunger body 64 further outwardly until the conducting face 68 engages two conducting strips 78 and 80 affixed to the inner surface of the cover 76.

Figure 5:
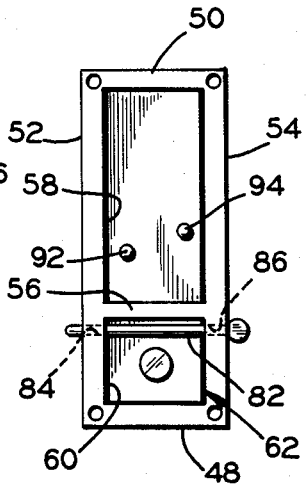
FIG. 5 is a left end view of the case of FIG. 3 with the cover removed.

The plunger 62 can be prevented from moving to the outer position by means of a locking pin 82 (FIG. 5) which extends through two holes 84 and 86 in the side walls 52 and 54. With the alarm 22 in place, the pin 82 can be inserted through the holes 84 and 86 to limit outward movement of the plunger 62 when the alarm is removed.

Figure 3:
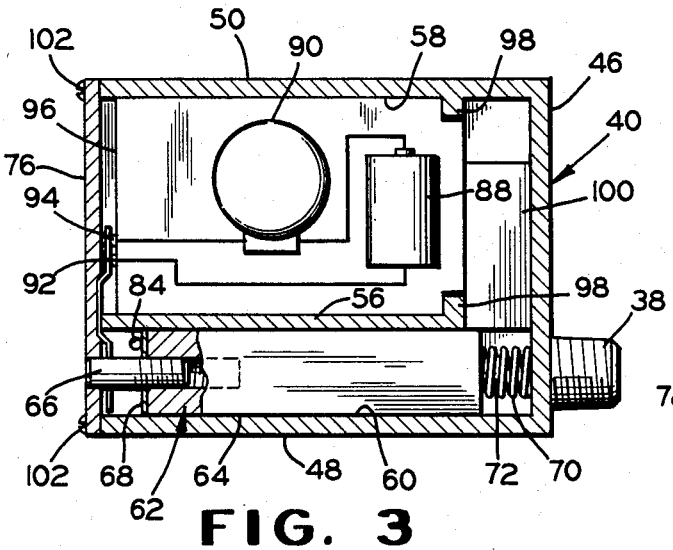
FIG. 3 is a somewhat schematic view in vertical cross section through a case and components of the alarm locked in the unarmed position.
Figure 4:
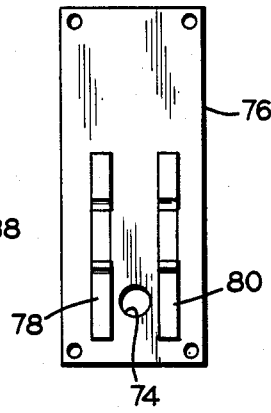
FIG. 4 is a view in elevation of a cover of FIG. 3.

A signaling system is located in the compartment 58 and is activated by the plunger body 64 when the plunger moves outwardly. As shown in FIG. 3, the signaling system includes a source of power, shown as a battery 88, connected in series with a signal 90, shown as a buzzer, or bell, with two electrical contacts 92 and 94 adjacent the cover 76. When the conducting face 68 engages both of the strips 78 and 80, a circuit is completed to cause the signal 90 to be activated. Besides being a sound signal, the signal can also emit sending waves in the form of radio waves or the like to activate a remotely located burglar alarm. This sending unit can be similar to a hand-carried transmitter for a garage door opener.

In a preferred form, the signaling system is mounted in a module 96 which can be inserted into the compartment 58 when the front cover 76 of the case 40 is removed. The module 96 can then be held in position by ribs or flanges 98 on the top wall 50 and the guide wall 56.

The module 96 has the advantage that it can be inserted in the case 40 at the time of sale to the consumer to meet the consumer's requirement for a sound signal or a sending signal in the signaling system. This eliminates the need for having completely separate alarms 22 for each of the types of signals. The module can also be readily removed for repair or battery replacement.

Figure 6:
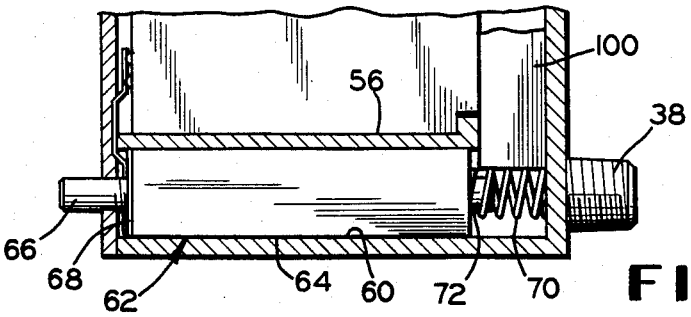
FIG. 6 is a further enlarged, fragmentary view in section of a portion of the case and components of FIG. 3, with the components shown in the alarm position and locked therein.

Another feature of the alarm 22 in accordance with the invention is that the plunger pin 66 cannot be pushed back into the case 40 by a burglar to shut off the alarm. To prevent such movement, a gravity-operated block 100 in accordance wtih the invention is located between the flanges 98 and the rear wall 46 of the case 40. When the plunger body 64 moves outwardly, the lower end of the block 100 moves between the rear wall 46 and the rear end of the plunger body 64, as shown in FIG. 6, to prevent rearward movement of the plunger body. The block 100 can then only be moved out of the path of the plunger 62 by turning the alarm 22 upside down so that the block moves by gravity toward the top wall 50 of the case 40. The occupant can readily do this while the ordinary burglar would not have the knowledge to do so.

From the above, it will be seen that the simplified alarm 22 employs fewer parts than the alarm my application Ser. No. 525,952 and is simpler to manufacture. In assembly, the gravity-operated block 100 can simply be inserted between the flanges 98 against the back wall 46 of the case 40 and the module 96 then inserted. The cover 76 can then be assembled with screws 102 or similar fasteners.

Various modifications of the above-described embodiments of the invention will be apparent to those skilled in the art and it is to be understood that such modifications can be made without departing from the scope of the invention, if they are within the spirit and the tenor of the accompanying claims.

I claim:

1. A burglar alarm for a sliding door or the like comprising a rod member having one end adapted to engage one of a movable frame of the door and a stationary frame, a case located at the other end of said rod member, a plunger extending outwardly from said case and adapted to engage the other of said door frame and said stationary frame, resilient means urging said plunger outwardly toward the associated frame, an alarm system in said case comprising a source of power, signal means connected with said source of power, a pair of electrical contacts connected with said source and said signal means, said plunger having conductive means engageable with said contacts when said plunger moves further outwardly of said case under the force of said resilient means when the plunger is moved away from the associated frame to cause said power source to activate said signal means, and gravity-operated means for preventing said plunger from being pushed inwardly into the case when said conductive means engages said electrical contacts.

2. A burglar alarm according to claim 1 characterized by a locking member slidably insertable into said case and having a position engageable with said plunger to prevent movement of said plunger out of said case when the plunger is moved away from the associated frame.

3. A burglar alarm according to claim 1 wherein said gravity-operated means comprises a block located within said case and having one position in the path of said plunger and another position out of the path of said plunger.

4. A burglar alarm according to claim 3 wherein said block is located between said plunger and said case when said block is in its first position.

5. A burglar alarm according to claim 1 wherein said plunger has a plunger body in said case and a plunger pin extending through an opening in a wall of said case.

6. A burglar alarm according to claim 5 wherein said plunger pin is longitudinally adjustable relative to said plunger body.

7. A burglar alarm according to claim 1 wherein said source of power, said signal means, and said pair of electrical contacts are located in a module separable from said case.

8. A burglar alarm according to claim 1 characterized by conducting strips located in the path of said plunger and engageable with the electrical contacts connected with said source and said signal means, and said conductive means of said plunger being located on a face thereof engageable with said strips when said plunger moves further outwardly of said case under the force of said resilient means.

9. A burglar alarm for a sliding door or the like comprising a rod member, a case attached at one end to said rod member, said case having a guide wall therein dividing the interior into a module chamber and a plunger chamber, said case having a removable cover for inserting a module into said module chamber, a plunger having a plunger body located in said plunger chamber and a plunger pin extending outwardly from said case, means in said plunger chamber urging said plunger pin outwardly, said plunger having a conductive face completing a circuit between electricl contacts of a module in said module chamber to activate a signal in the module when said plunger is in its outermost position.

10. A burglar alarm according to claim 9 wherein said plunger pin is longitudinally adjustable relative to said plunger body.

11. A burglar alarm according to claim 9 characterized by gravity-operated means for preventing said plunger from being pushed inwardly into said case when said conductive face completes a circuit between the electrical contacts of the module.

12. A burglar alarm according to claim 9 wherein said removable cover has conducting strips on an inner surface thereof for engaging the electrical contacts of said module when said cover is mounted on said case, said conductive face of said plunger engaging said conducting strips when said plunger is in its outermost position.

13. A burglar alarm according to claim 11 wherein said means for preventing said plunger from being pushed into said plunger chamber has one position in the path of said plunger between said plunger and said case and another position spaced from the path of said plunger.

14. A burglar alarm according to claim 13 wherein said gravity-operated means is a block.

15. A burglar alarm for a sliding door or the like having a movable frame slidable in a stationary frame, said alarm comprising an adjustable blocking member having one end adapted to engage one of said movable frame and said stationary frame, a case affixed to the other end of said blocking member and having a guide wall therein dividing the interior into a module chamber and a plunger chamber, a plunger having a plunger body movable longitudinally in the plunger chamber and having a plunger pin extending through an opening in a wall of said case, said plunger pin being adapted to engage the other of said movable frame and said stationary frame, an alarm module receivable in said module chamber and containing a power source, a signal source, and electrical contact means, said plunger body having engageable means completing a circuit between said electrical contact means when said plunger is in an outer position, resilient means in said plunger chamber urging said plunger toward the outer position, means preventing said plunger from being pushed into said plunger chamber when said engageable means is engaged with said electrical contact means, and a locking member engageable with said plunger body to prevent said plunger from moving outwardly.

16. A burglar alarm according to claim 15 wherein said engageable means of said plunger body is a conductive face on said plunger body around said plunger pin.

17. A burglar alarm according to claim 15 wherein said locking member is extendable through openings in said case and having a portion positioned in the path of said plunger body.

18. A burglar alarm according to claim 15 wherein said case has a removable cover to enable said module to be inserted into said module chamber.

19. A burglar alarm according to claim 18 wherein said cover has conducting strips engageable with said electrical contact means and with said engageable means of said plunger body when said plunger is in the outer position.

20. A burglar alarm according to claim 19 wherein said removable cover has a hole between said conducting strips through which said plunger pin extends.

* * * * *